US006997756B2

(12) United States Patent
Nakamura

(10) Patent No.: US 6,997,756 B2
(45) Date of Patent: Feb. 14, 2006

(54) CONNECTOR TERMINAL, A CONNECTOR AND A MOUNTING METHOD

(75) Inventor: Hideto Nakamura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/798,983

(22) Filed: Mar. 11, 2004

(65) Prior Publication Data

US 2004/0180582 A1 Sep. 16, 2004

(30) Foreign Application Priority Data

Mar. 12, 2003 (JP) ..... 2003-066332
Mar. 25, 2003 (JP) ..... 2003-082613
Apr. 2, 2003 (JP) ..... 2003-098834

(51) Int. Cl.
*H01R 13/40* (2006.01)

(52) U.S. Cl. ..... 439/751; 439/733.1

(58) Field of Classification Search ..... 439/733.1, 439/891, 751, 873, 943, 84; 200/284, 264
See application file for complete search history.

(56) References Cited

U.S. PATENT DOCUMENTS 5,286,218 A * 2/1994 Sakurai et al. ..... 439/733.1
5,989,075 A * 11/1999 Hsiao et al. ..... 439/733.1

FOREIGN PATENT DOCUMENTS

JP 2000-251993 9/2000

* cited by examiner

*Primary Examiner*—Tho D. Ta
*Assistant Examiner*—Felix O. Figueroa
(74) *Attorney, Agent, or Firm*—Gerald E. Hespos; Anthony J. Casella

(57) ABSTRACT

A connector terminal (1) has a tab (2) fittable into a mating terminal and a press-in portion (3) to be pressed into a press-in protrusion (11) of a housing (10). The press-in portion (3) includes a base (5) having a total of two press-in sections (5*a*) on its opposite side surfaces, and two branches (6) branched off from the base (5) and having one press-in section (6*a*) formed on each of the opposite side surfaces thereof. The connector terminal (1) has a total of six press-in sections (5*a*, 6*a*), and the connector terminal (1) can be held in the housing (10) with an enhanced force even without increasing the width of the connector terminal (1) and a dimension of the press-in protrusion (11) of the housing (10) along a pressing direction.

5 Claims, 18 Drawing Sheets

CONNECTOR TERMINAL, A CONNECTOR AND A MOUNTING METHOD

BACKGROUND OF THE INVENTION

1. Field of the Invention

The invention relates to a terminal to be pressed into a connector housing, to a connector and to a mounting method therefor.

2. Description of the Related Art

Japanese Unexamined Patent Publication No. 2000-251993 discloses a connector terminal with a plurality of press-in sections formed on each of the side surfaces thereof along a pressing direction. The terminal can be fixed by pressing these press-in sections into a connector housing.

A holding force of the terminal pressed into the housing can be increased by increasing the number of the press-in sections. However, even if many press-in sections are formed on each side surface of the terminal along the pressing direction, a sufficient holding force cannot be ensured for the press-in sections pressed later due to the scrape of the housing caused by the press-in section of the press-in section pressed before. Thus, the holding force is not enhanced very much. The widths of the press-in sections pressed in later must be larger than the widths of the press-in sections pressed in before to improve the holding forces of the press-in sections to be pressed into later. However, the terminal becomes larger if too many press-in sections are formed on each side surface along the pressing direction. Further, it is difficult to form many press-in sections on each side surface of the terminal due to restrictions on the dimensions of press-in portion along the press-in direction.

An increased number of press-in sections can increase the holding force of a terminal pressed into the housing. However, a narrow terminal with a plurality of press-in sections may not be sufficiently strong. The terminal or the housing may be engaged with a lock. However, it is difficult to form a narrow terminal with a lock for engaging the housing. It is also difficult to form a narrow terminal with an engaging hole to be engaged by a lock of the housing.

Furthermore, it becomes more difficult to press the terminal into the housing because a larger force is required to insert a terminal that has a large number of press-in sections.

The invention was developed in view of the above problems and an object thereof is to provide a connector terminal that can be held in a housing with a large holding force and preferably having a small size and a light weight.

SUMMARY OF THE INVENTION

The invention relates to a connector terminal with at least one press-in portion so that the terminal can be pressed into a connector housing in a pressing direction. The press-in portion comprises a base formed on at least one side surface of the press-in portion, and the base has at least one press-in section to be pressed into the housing. The press-in portion also has at least one branch branched from the base. The branch is formed with at least one press-in section on at least one outer side surface to be pressed into the housing. A projecting distance of the press-in section on the base in a direction substantially normal to the pressing direction of the press-in section exceeds the projecting distance of the press-in section on the branch.

The press-in section on the branch is inserted first and the press-in section of the base is pressed in later. However, the relative positions ensure that the press-in section of the branch will not scrape the same part of the housing that will subsequently be engaged by the press-in section of the base. Thus, the holding force is sufficient.

The press-in sections preferably are formed on opposite side surfaces of the base. Plural branches preferably are branched off from the base and press-in sections preferably are formed on opposite side surfaces of each branch. The width between the press-in sections on the base preferably exceeds the width between the press-in sections on the branches.

A tab preferably extends integrally or unitarily from the press-in portion and fits into a mating terminal. The branches preferably extend in a direction substantially opposite from the direction towards the tab.

The press-in sections preferably are on opposite sides of the base and opposite sides of the branches. Thus, the total number of press-in sections can be increased while suppressing the number of the press-in sections formed on each side surface of the terminal. As a result, a holding force to hold the terminal in the housing can be increased without considerably increasing either the width of the terminal or a dimension of a press-in portion of the housing along the pressing direction. Further, the width between the press-in sections on the base exceeds the width between the press-in sections on the branches. Thus, a sufficiently large holding force can be ensured by the press-in sections formed on the base and are pressed into later.

Preferably, only one press-in section is formed on each side surface of each branch. Thus, stresses that act when the branches are pressed in can be reduced to prevent damage and deformation of the branches even though the branches have less strength than the base.

The press-in sections on the branches preferably are at base ends of the branches. Thus, the branches are stronger while being pressed in, and are prevented from damage and deformation.

The branches preferably comprise an engaging portion for connection with an external circuit, such as a printed circuit board.

The invention also relates to a terminal that is to be mounted into a connector by inserting the terminal substantially along an insertion direction into a housing of the connector. The terminal includes an inserting portion integrally or unitarily formed with a tab and insertable substantially along an inserting direction into a mount hole that penetrates a mount portion of the housing. Locks project at an angle to the inserting direction. The locks are spaced apart along the longitudinal direction of the terminal and the inserting portion is between the locks. Each lock of the terminal preferably has two oppositely projecting protuberances. The locks of the terminal preferably are spaced apart by a distance that is less than the length of the mount portion of the housing along the longitudinal direction of the terminal.

The invention also relates to a connector comprising a housing and at least one terminal as described above. The housing has a mount hole and a guide hole into which the inserting portion can be inserted, but into which the locks cannot be inserted. An insertion portion is formed integrally with the guide hole and bulges out from the guide hole at an angle to the inserting direction to permit insertion of at least one lock. The terminal preferably is mounted into the mount portion by being turned about its longitudinal axis to engage the respective locks with the mount portion after one lock has been inserted into the insertion portion of the housing. Accordingly, the connector enables a terminal to be held in a housing with an increased holding force even if the terminal is narrow.

Each lock of the terminal preferably is comprised of two protuberances that project in substantially opposite directions from the inserting portion. The insertion portion of the housing comprises two substantially facing slits at opposite sides of the guide hole for receiving a lock. As a result the terminal can be mounted stably into the mount portion without being inclined.

A distance between the locks of the terminal preferably is less than the length of the mount portion of the housing along the longitudinal direction of the terminal. The mount portion is held between the locks when the terminal is mounted into the mount portion. Thus, the terminal can be mounted stably into the mount portion without shaking.

The invention also relates to a method of mounting a terminal into a housing of a connector. The method comprises providing a terminal that has an inserting portion integrally or unitarily formed with a tab and a plurality of locks projecting from the inserting portion at an angle to the inserting direction. The locks are spaced apart along the longitudinal direction of the terminal so as to locate the inserting portion therebetween. The method also comprises providing a housing having a mount hole that includes a guide hole into which the inserting portion can be inserted, but into which the locks cannot be inserted. An insertion portion is formed integrally with the guide hole and bulges out at an angle to the inserting direction from the guide hole to permit at least partial insertion of at least one lock. The method then includes inserting the terminal fitting along an inserting direction into the mount hole.

The terminal preferably is mounted into the mount portion by being turned about its longitudinal axis to engage the respective locks with the mount portion after having one lock inserted into the insertion portion of the housing.

The invention also relates a connector that comprises a housing and a terminal to be inserted into the housing. One of the housing and the terminal is formed with a flexible engaging piece, and the other of the housing and the terminal is formed with an engaging portion engageable with the engaging piece to prevent the terminal from coming out of the housing. Thus, the terminal can be held firmly in the housing by the engagement of the engaging piece and the engaging portion without increasing a pressing force.

The terminal preferably is formed unitarily or integrally with a tab that is fittable into a mating terminal and includes at least one press-in section to be pressed into the housing. Accordingly, the terminal can be held in the housing with a larger holding force.

The terminal preferably has four outer surfaces to be opposed to the housing. The press-in section is formed on each of two facing outer surfaces, and either the locking piece or the engaging piece is formed on each of two remaining facing outer surfaces. Thus, a sufficient space for forming the press-in section, the engaging piece or the engaging portion can be ensured on the terminal.

The terminal preferably is formed with the engaging pieces, and the housing preferably is formed with engaging projections engageable with the engaging pieces to prevent the terminal from coming out of the housing. Thus, the strength of the engaging pieces can be enhanced, and deformation and damage of the engaging pieces caused by the connection and separation of the connector can be prevented.

The terminal preferably is substantially flat and is formed with a plurality of engaging pieces by making cuts in the substantially flat terminal. The cut sections then are bent in opposite directions. Alternatively, the substantially flat terminal may be embossed.

The housing preferably has two facing surfaces to face the outer surfaces of the terminal where the engaging pieces are formed. Each of the facing surfaces is formed with the engaging projection that is engageable with the corresponding engaging piece to prevent the terminal from coming out of the housing. Thus, the terminal can be held stably and firmly in the housing without being inclined.

The housing preferably has the engaging piece and the terminal preferably has an engaging hole engageable with the engaging piece to prevent the terminal from coming out of the housing. Thus, the invention is applicable to smaller terminals having no space for forming the engaging piece.

These and other objects, features and advantages will be more apparent upon reading the following detailed description of preferred embodiments and accompanying drawings. Embodiments are described separately, but features may be combined to additional embodiments.

DETAILED DESCRIPTION OF THE PREFERRED EMBODIMENTS

Figure 1:
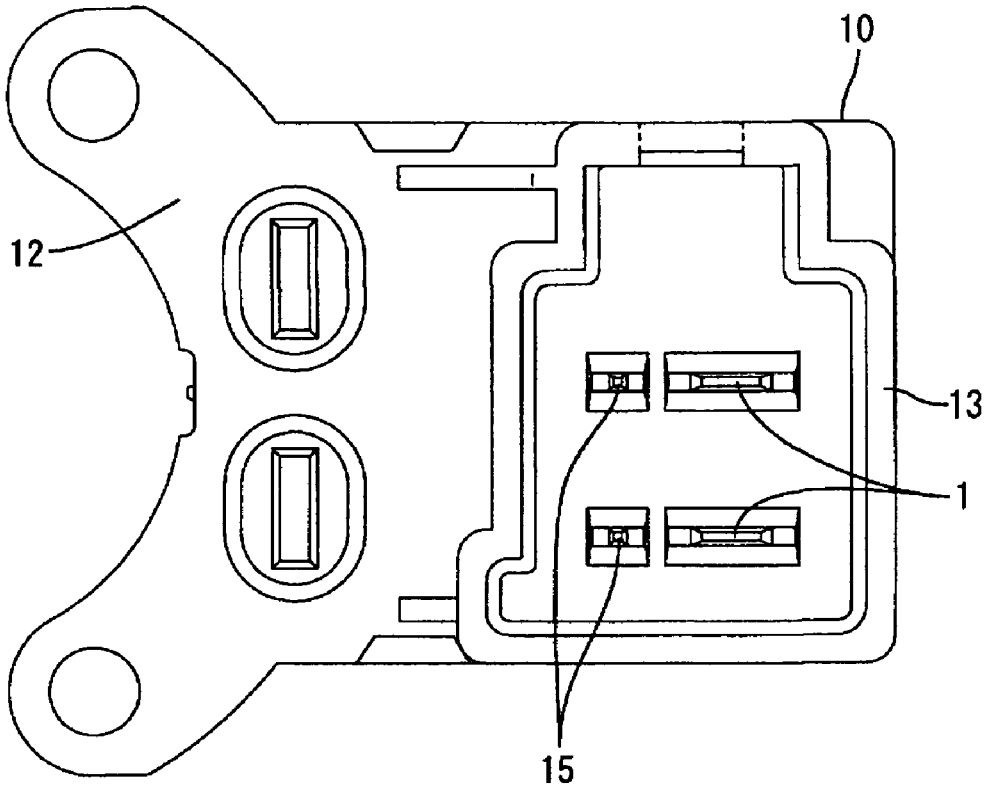
FIG. 1 is a top view of a connector in which terminals according to one embodiment of the invention are used.
Figure 2:
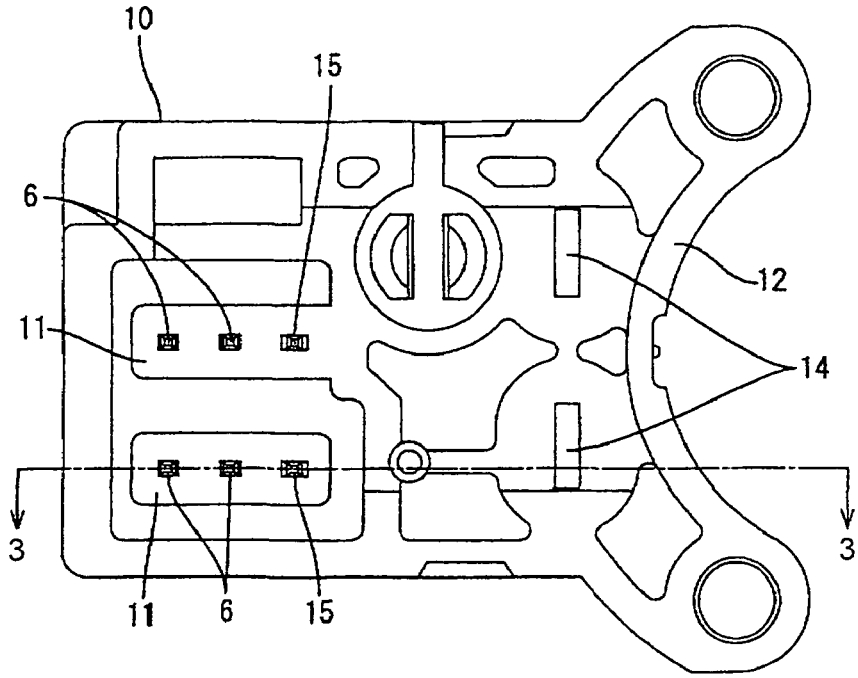
FIG. 2 is a bottom view of the connector of FIG. 1.
Figure 3:
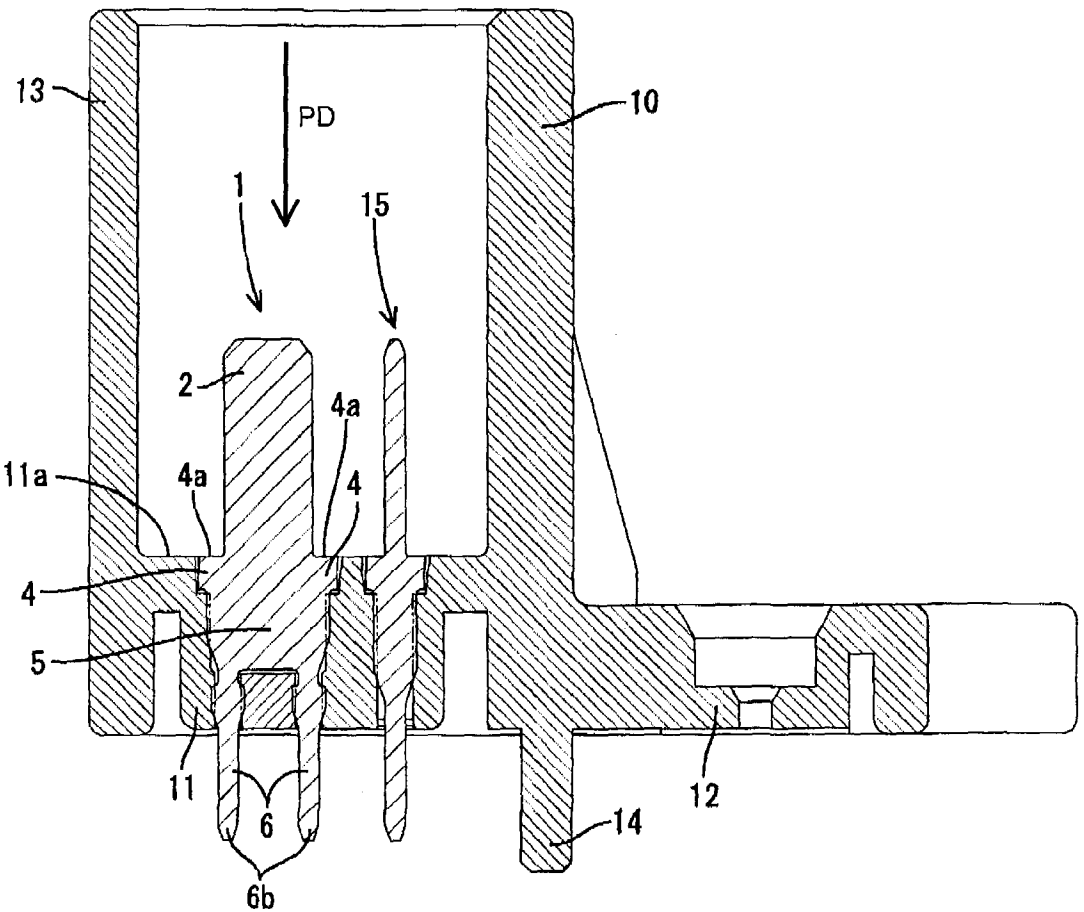
FIG. 3 is a section along 3—3 of FIG. 2.

A connector according to a first embodiment of the invention is described with reference to FIGS. 1 to 5. As shown in FIGS. 1 to 3, a circuit board connector has two terminals 1 pressed from above and in a pressing direction PD into press-in protrusions 11 of a housing 10. The housing 10 is molded unitarily e.g. of a synthetic resin and has a flange 12 mountable e.g. on an electronic circuit board (not shown). The housing 10 has a receptacle 13 into which e.g. a cable-side connector (not shown) is fittable, and a projection 14 for positioning the housing 10 with respect to the electronic circuit board. In FIG. 3, the electronic circuit board is to be mounted on the lower surface of the flange 12. The connector also has two narrower terminals 15 pressed into the press-in protrusions 11 of the housing 10 in addition to the terminals 1.

Figure 4:
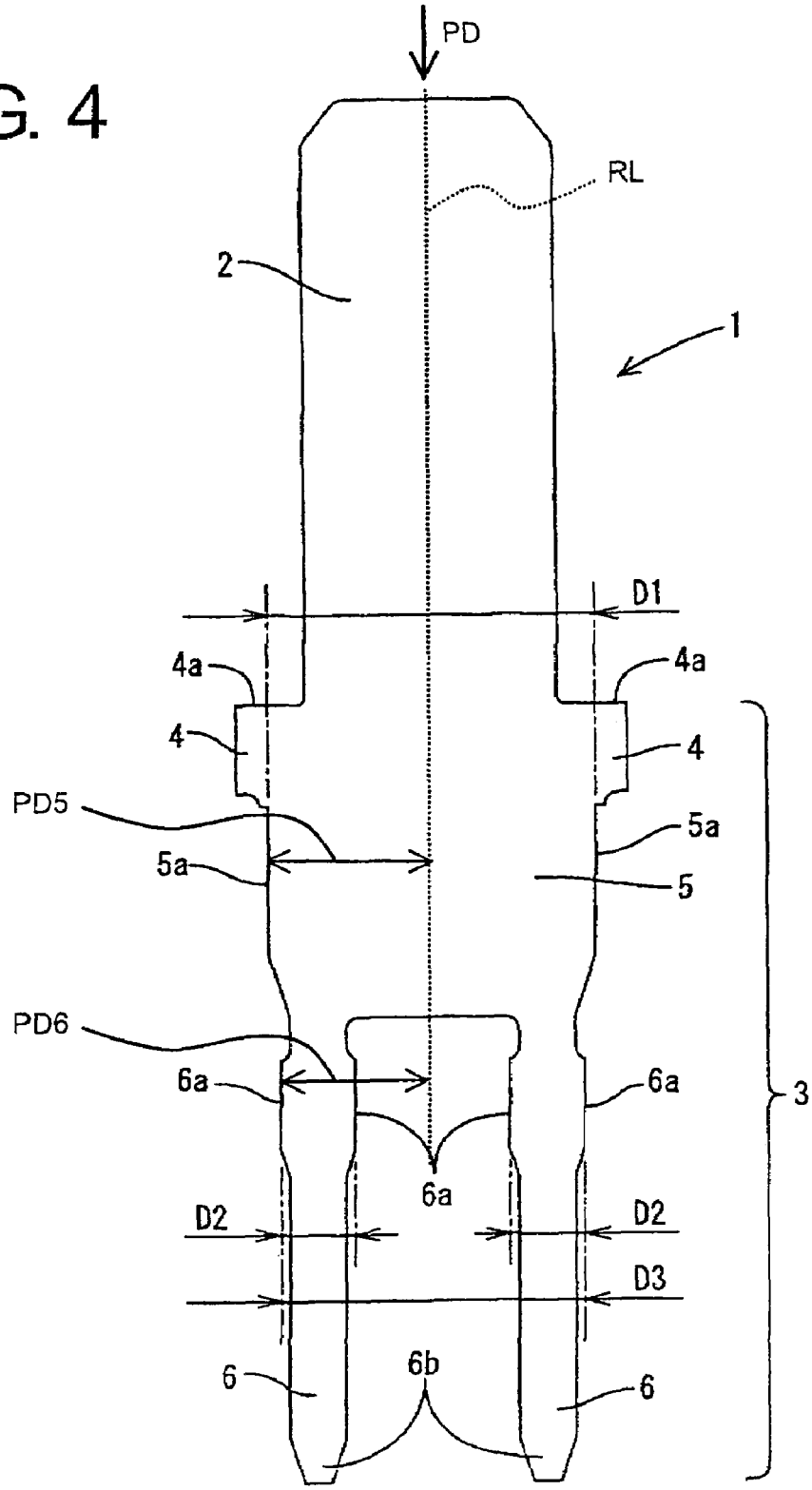
FIG. 4 is a front view enlargedly showing the terminal of FIG. 1.

Each terminal 1 is formed unitarily by press-working a conductive (metallic) plate. More particularly, each terminal 1 has a tab 2 and a press-in portion 3 formed continuously below the tab 2, as shown in FIG. 3. The tab 2 is fittable into a mating terminal and the press-in portion 3 is pressed into the press-in protrusion 11 of the housing 10. The press-in portion 3 includes two receiving portions 4 formed respectively at substantially opposite sides. The receiving portions 4 are pressed down in the pressing direction PD by a terminal pressing jig. A base 5 is formed continuously below the tab 2 and two branches 6 are branched off from the base 5 and extend down in the pressing direction PD. Thus, the branches 6 extend in a direction substantially opposite from the tab 2. As shown in FIG. 4, the branches 6 have identical shapes.

Press-in sections 5*a* are formed respectively on the two opposite side surfaces of the base 5 and are configured to be pressed into the press-in protrusions 11 of the housing 10. The press-in sections 5*a* are substantially flat surfaces aligned substantially parallel with the pressing direction PD. A width D1 between the press-in sections 5*a* is set to provide a suitable holding force in interaction with the press-in protrusion 11 of the housing 10. Further, the side surfaces of an upper part of each branch 6 bulge out laterally to the left and right in directions substantially normal to the pressing direction PD. One press-in section 6*a* is formed at each bulged-out surface (a total of four). The press-in sections 6*a* are substantially flat surfaces aligned substantially parallel with the pressing direction PD. A width D2 between the press-in sections 6*a* of each branch 6 is set to provide a suitable holding force in interaction with the press-in protrusion 11 of the housing 10.

A reference line RL is considered to exist at the middle of the terminal 1 and extends substantially parallel to the pressing direction PD. The press-in portion 5*a* on a first side of the terminal 1 projects from the reference line RL in a direction substantially normal to the pressing direction PD by a projecting distance PD5. The outer press-in section 6*a* on the first side of the terminal 1 projects from the reference line RL in a direction substantially normal to the pressing direction PD by a projecting distance PD6. The distance PD5 is larger than the distance PD6. Accordingly, the width D1 between the press-in sections 5*a* and width D3 between the outer press-in sections 6*a* of the two branches 6 satisfies a relationship D1>D3. Thus, the holding force effected by pressing the press-in sections 5*a* on the base 5 can be maintained even if the housing 10 is scraped off by the press-in sections 6*a* on the branches 6 and pressed in first. An engaging portion 6*b* is formed at the leading end of each branch 6 for engaging a through hole of the electric or electronic circuit board and is connected electrically with a circuit pattern by mounting the housing 10 on the circuit board.

Figure 5:
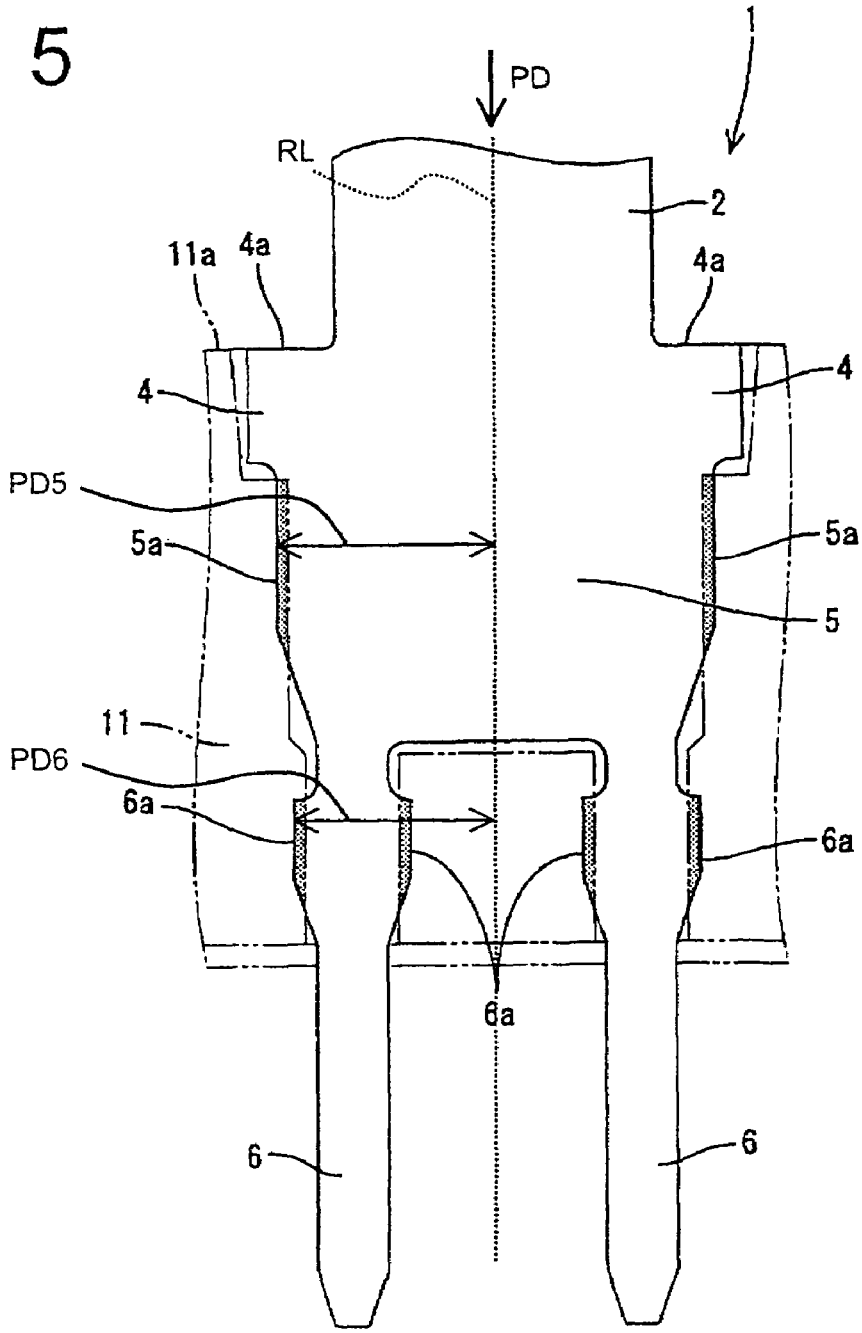
FIG. 5 is an enlarged view showing an essential portion of FIG. 3.
Figure 6:
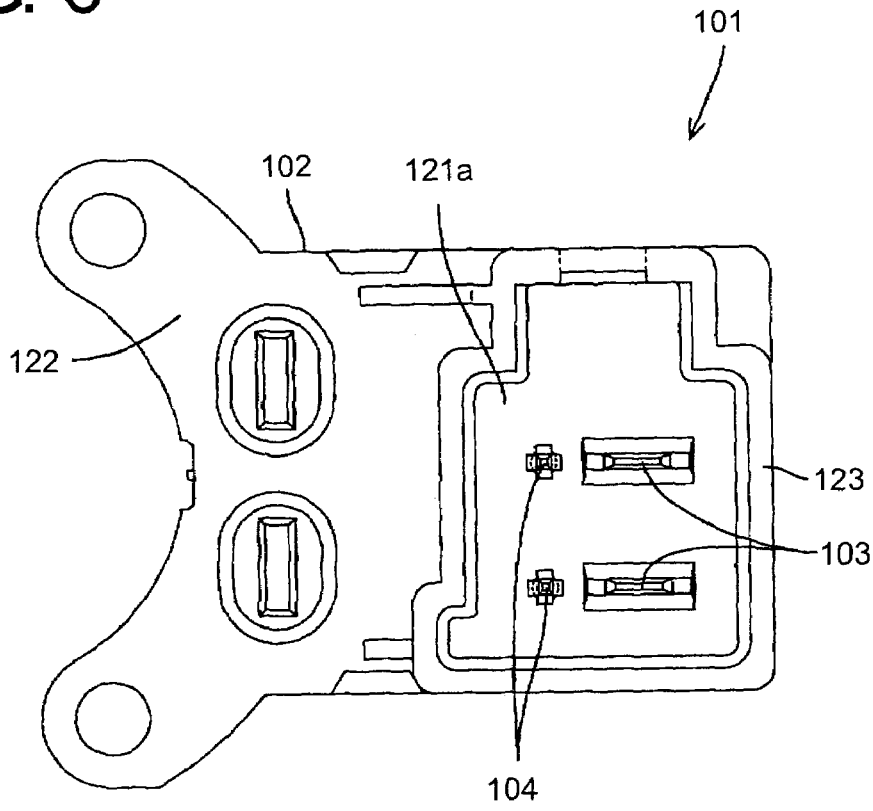
FIG. 6 is a plan view of a connector according to a further embodiment of the invention.
Figure 7:
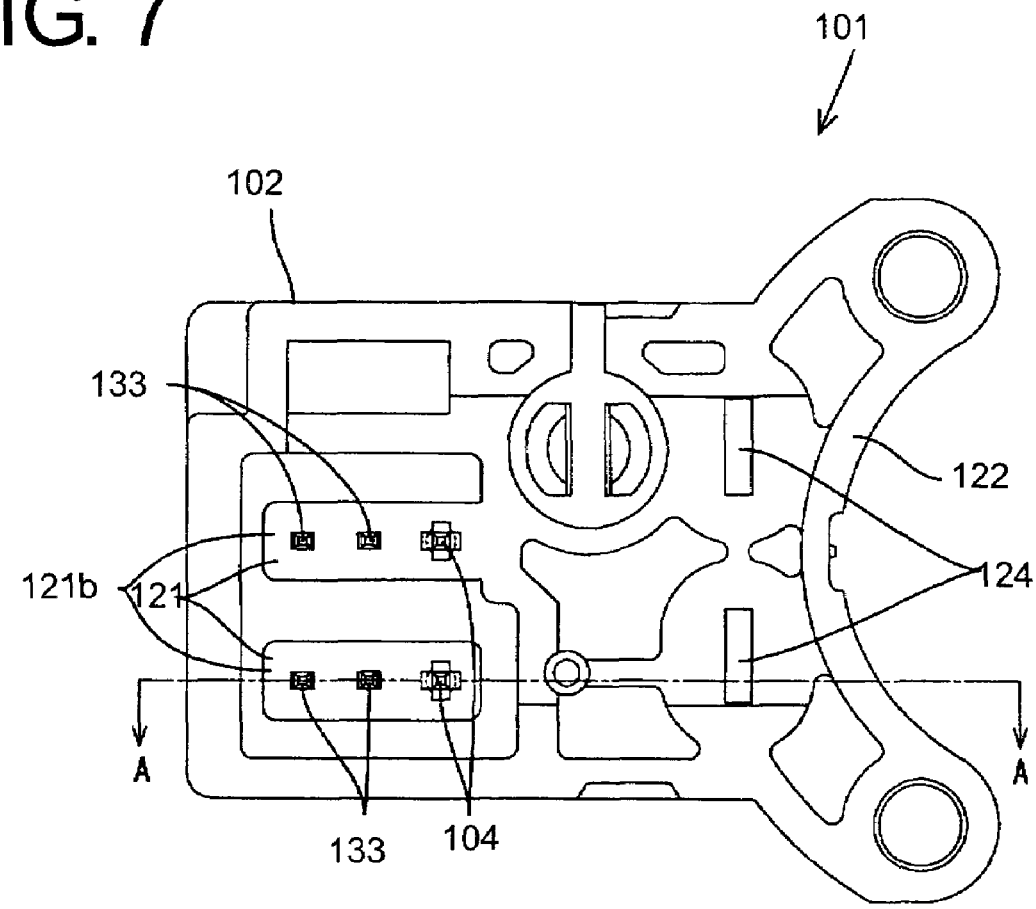
FIG. 7 is a bottom view of the connector of FIG. 6.

The terminal 1 is pressed into the press-in protrusion portion 11 of the housing 10 by pressing upper surfaces 4*a* of the receiving portions with the terminal pressing jig (not shown). The upper surfaces 4*a* of the receiving portions 4 are pressed until the bottom pressing surface of the terminal pressing jig contacts an upper end surface 11*a* of the press-in protrusion 11. As shown in FIGS. 3 and 5, the terminal 1 is pressed into the housing 10 so that the two press-in sections 5*a* on the opposite sides of the base 5 and four press-in sections 6*a* on the opposite sides of the respective branches 6 (i.e. a total of six press-in sections 5*a*, 6*a*) exhibit a specified holding force. Hatched portions in FIG. 5 show the press-in sections of the terminal 1.

The press-in portion 3 is comprised of the base 5 having the press-in sections 5*a* on the opposite side surfaces thereof and the two branches 6 branched off the base 5 and each having press-in sections 6*a* formed on the opposite side surfaces thereof. Thus, the total number of the press-in sections can be increased to six while reducing the number of the press-in sections on each side surface of the terminal along the pressing direction PD to two. Accordingly, the terminal 1 can be held in the housing 10 with an increased force without considerably widening the terminal 1 and a dimension of the press-in protrusions 11 of the housing 10 along the pressing direction PD. Further, the press-in sections 5*a* of the base 5 are pressed into the housing 10 later and exhibit a large holding force by making the width between the press-in sections 5*a* on the base portion 5 larger than the width between the press-in sections 6*a* on the branches 6.

The branches 6 are not as strong as the base 5. However, only one press-in section 6*a* is formed on each side surface of each branch 6 along the pressing direction PD. Thus, stresses acting when the branches 6 are pressed in can be reduced to prevent damage and deformation of the branches 6. Further, the press-in sections 6*a* are at the base ends of the branches 6. Thus, the branches 6 can be stronger when pressed in and will not be damaged and deformed.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The number of the branches is not necessarily two. Three or more branches may be provided in accordance with a required holding force and a permissible size of the terminal.

The press-in sections of the terminal may give press-in margins along a thickness direction, which is substantially normal to the plane of FIG. 5 and normal to the pressing direction PD for the housing instead of giving press-in margins along a widthwise direction as described above.

The present invention may also be applied to a terminal for connector other than the circuit board connector.

The housing may comprise press-in portions having a shape different than the described press-in protrusions, e.g. may be provided in a housing main body without any protrusion.

Figure 8:
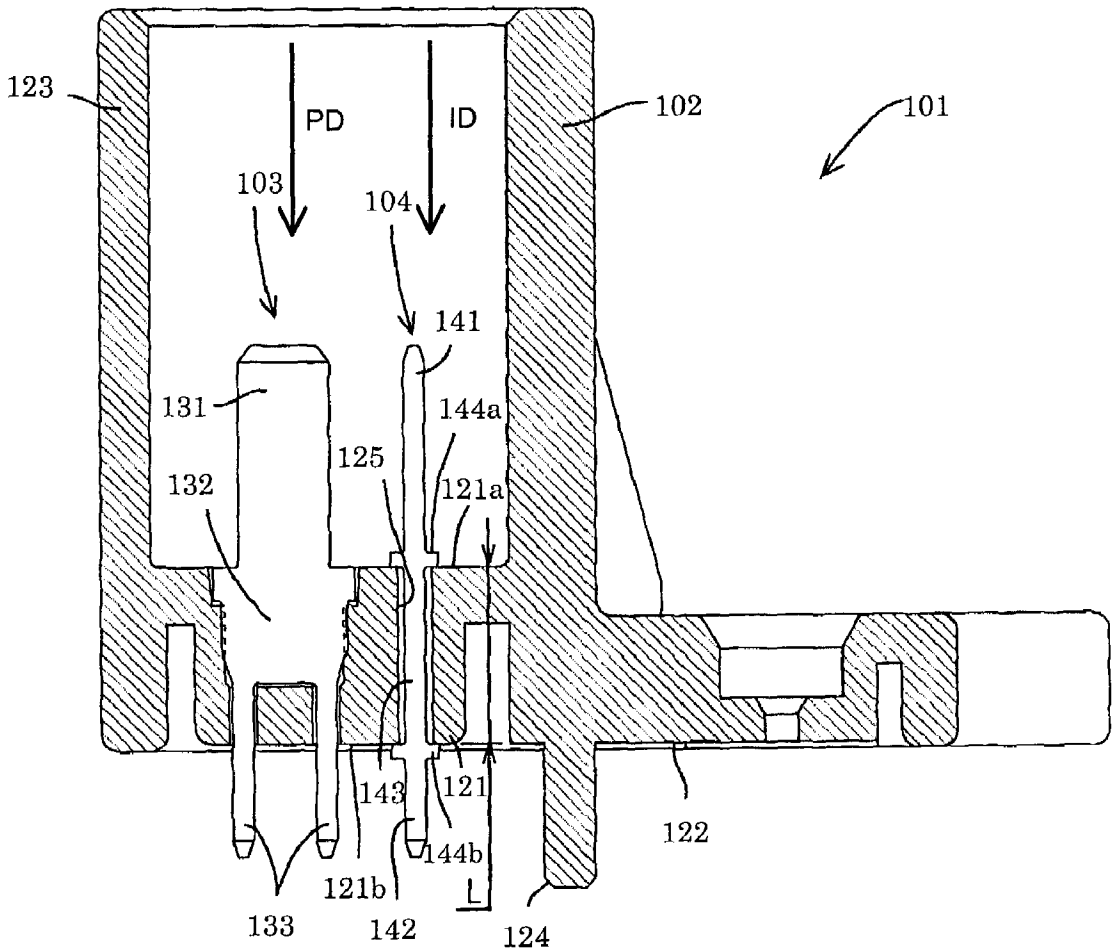
FIG. 8 is a section along 8—8 of FIG. 7.

A connector according to a second embodiment of the invention is identified by the numeral 101 in FIGS. 6 to 11. The connector 101 preferably is a circuit board connector, and has a housing 102 that accommodates two substantially flat terminals 103 and two narrow terminals 104. The housing 102 is molded unitarily of a synthetic resin, and has a flange 122 mountable on an external circuit, such as an electric or electronic circuit board (not shown). The housing 102 also has a receptacle 123 into which a cable-side connector (not shown) is fittable, and a projection 124 for positioning the housing 102 with respect to the electronic circuit board. In FIG. 8, the electronic circuit board is to be mounted on the lower surface of the flange 122.

Each flat terminal 103 is formed unitarily by press-working a conductive metallic plate and, as shown in FIG. 8, has a tab 131 that is fittable into a mating terminal. A base 132 is formed continuously near the tab 131, and mounting portions 133 are branched downward in a pressing direction PD from the base 132. Leading ends of the pressing portions 133 are electrically connectable with a circuit pattern of the electronic circuit board upon mounting this connector on the electronic circuit board. The flat terminal 103 is to be pressed into a mount portion 121 of the housing 102 in a pressing direction PD from above to have the base 132 of the flat terminal 103 fixed.

Figure 9:
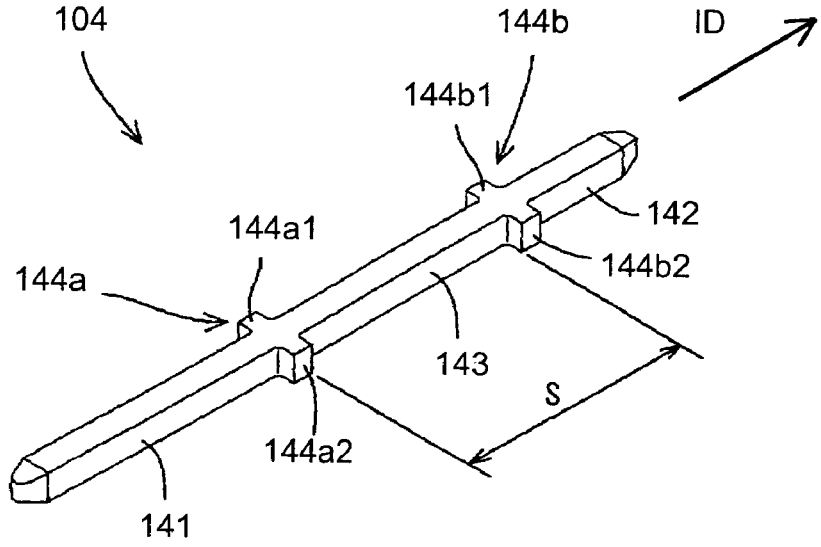
FIG. 9 is a perspective view of the terminal of FIG. 6.

The terminals 104, as shown in FIGS. 8 and 9, are narrower than the flat terminals 103 and are formed unitarily of a conductive material, such as a metal. A tab 141 is formed at an upper end of each terminal 104 and is fittable into a mating terminal. A mounting portion 142 is formed at a bottom projecting end of each terminal 104 and has a leading end that is electrically connectable with the circuit pattern upon mounting the connector on the electric or electronic circuit board. An inserting portion 143 is formed between the tab 141 and the mounting portion 142 and is inserted in an inserting direction ID into a mount hole 125 in the mount portion 121 of the housing 12. Two locks 144*a*, 144*b* project out on the terminal 104 in directions substantially normal to the inserting direction ID. The locks 144*a*, 144*b* are formed at opposite sides of the inserting portion 143 so that the inserting portion 143 is between the locks 144*a*, 144*b*.

The lock 144*a* is comprised of two protuberances 144*a*1, 144*a*2 that project in substantially opposite directions from the inserting portion 143, and the lock 144*b* is comprised of two protuberances 144*b*1, 144*b*2 that project in substantially opposite directions from the inserting portion 143. As shown in FIG. 8, the lock 144*a* at the upper side engages an upper end surface 121*a* of the mount portion 121, whereas the lock 144*b* at the lower side engages a bottom end surface 121*b* of the mount portion 121. A distance S (see FIG. 9) between facing surfaces of the locks 144*a*, 144*b* is slightly less than length L (see FIG. 8) of the mount portion 121 along the longitudinal direction of the mount hole 125 (e.g. between about 95% to about 99% thereof). Thus, the terminal 104 can be fixed in the mount portion 121 by holding the mount portion 121 between the locks 144*a*, 144*b*. The inserting portion 143 has substantially the same cross section as the tab 141 and the mounting portion 142 in this embodiment. However, the structure of the terminal 104 is not necessarily restricted and the inserting portion 143 may have a different cross section from the tab 141 and/or the mounting portion 142.

Figure 10:
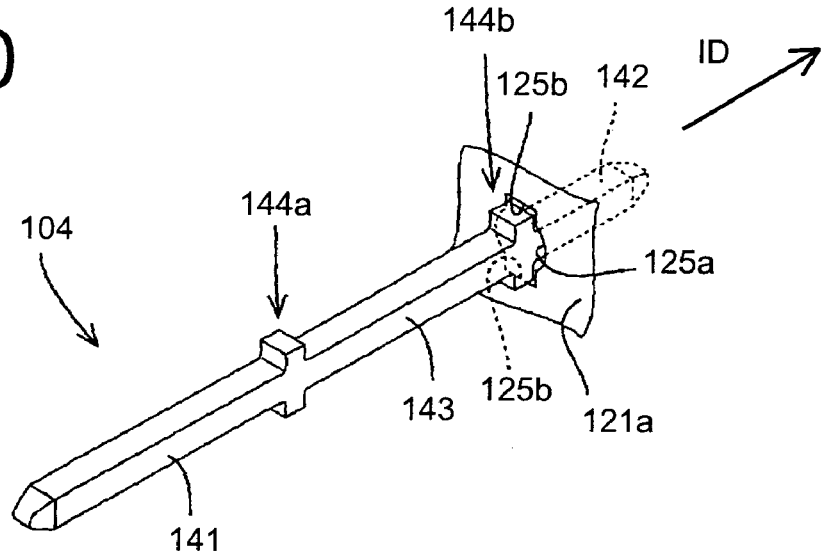
FIG. 10 is a diagram showing a method for mounting the terminal of FIG. 6 into the connector housing.
Figure 11:
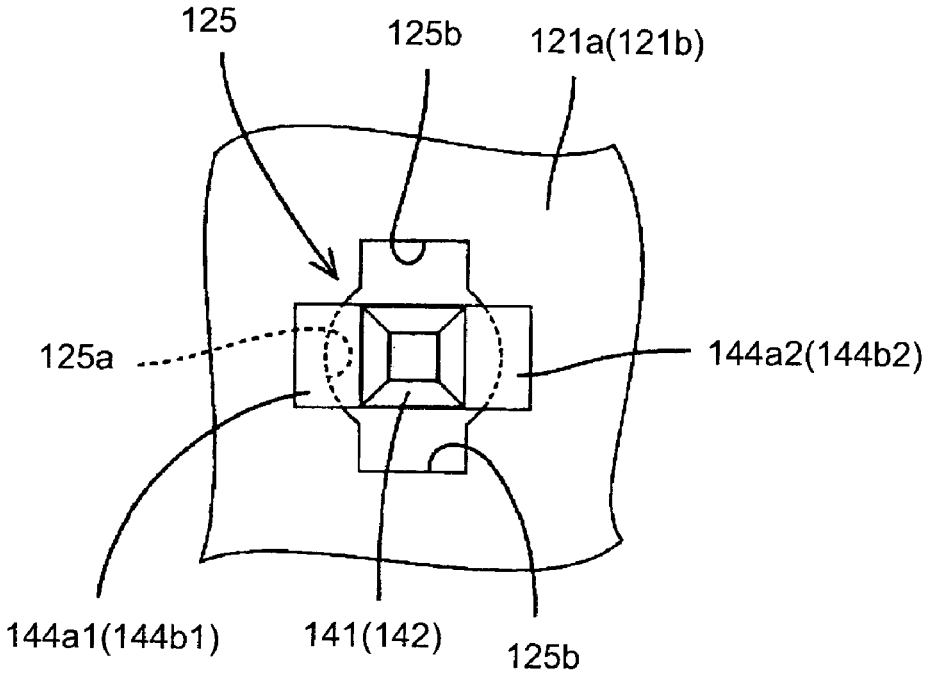
FIG. 11 is an enlarged view of an essential portion showing a state where the terminal is mounted into a mount hole of the connector housing.

The mount hole 125 of the housing 102 penetrates the mount portion 121, and the mounting portion 142 and the inserting portion 143 of the terminal 104 can be inserted therethrough as shown in FIGS. 10 and 11. The mount hole 125 is comprised of a guide hole 125*a* that has a substantially round cross section and into which the locks 144*a*, 144*b* cannot be inserted. Slits 125*b* are formed unitarily with the guide hole 125*a* and permit insertion of the locks 144*a*, 144*b*. The slits 125*b* have substantially rectangular cross sections, and are formed at two positions outward of the guide hole 125*a*. Additionally, the slits 125*b* extend in opposite directions with the guide hole 125*a* therebetween. Both the guide hole 125*a* and the slits 125*b* vertically penetrate the mount portion 121 of the housing 102. FIG. 11 shows a view of the terminal 104 from above or below when the terminal 104 is mounted into the mount portion 121. In FIG. 11, reference numerals in parentheses are a bottom view.

The mounting portion 142 at the bottom end of the terminal 104 is inserted into the guide hole 125*a* from the upper end surface 121*a* of the mount portion 121 as shown in FIG. 10. The lock 144*b* at the lower side then is inserted in the inserting direction ID into the slits 125*b*. The terminal 104 is turned about 90° about its longitudinal axis after the lock 144*b* passes the slits 125*b* and comes out from the bottom end surface 121*b* of the mount portion 121. As a result, the locks 144*a*, 144*b* engage the upper end surface 121*a* and the bottom end surface 121*b*, respectively, as shown in FIGS. 8 and 11. As a result, the terminal 104 is locked so as not to come out.

The distance S between the locks 144*a*, 144*b* of the terminal 104 is slightly less than the length L of the mount portion 121. Thus, the locking portions 144*a*, 144*b* hold the mount portion 121 therebetween from above and below when the terminal 104 is mounted into the mount portion 121, and the terminal 104 is fixed firmly to the mount portion 121. Instead of the mounting method described above, the tab 141 at the upper end of the terminal 104 may be inserted in substantially opposite to the inserting direction ID into the guide hole 125*a* from the bottom end surface 121*b* of the mount portion 121. The lock 144*a* at the upper side then is inserted into the slits 125*b* and the terminal 104 is turned approximately 90° about its longitudinal axis.

The terminal 104 is mounted into the mount portion 121 by inserting the lock 144*b* into the slit 125*b* and then turning the terminal 104 about its longitudinal axis to engage the locks 144*a*, 144*b* with the upper end surface 121*a* and the bottom end surface 121*b* of the mount portion 121. Thus, the terminal 104 is held in the housing 102 with a larger force without a press-in portion, a locking portion or the like. Further, the mount portion 121 is held between the locks 144*a*, 144*b* by making the distance S between the locks 144*a*, 144*b* slightly less than the length L of the mount portion 121 of the housing 102. Thus, the terminal 104 can be mounted stably into the mount portion 121 without shaking.

The locks 144*a* have protuberances 144*a*1, 144*a*2 and the locks 144*b* have protuberances 144*b*1, 144*b*2 projecting in opposite directions from the inserting portion 143. Additionally, the slits 125*b* are formed at two facing positions of the guide round 125*a*. Thus, the terminal 104 can be mounted stably into the mount portion 121 without being inclined.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The locks need not have an identical shape, and may have different shapes. In such a case, the slits of the mount hole may be such that at least one of the locks can be inserted therethrough.

The invention also may be applied to a terminal of a connector other than the circuit board connector.

Figure 12:
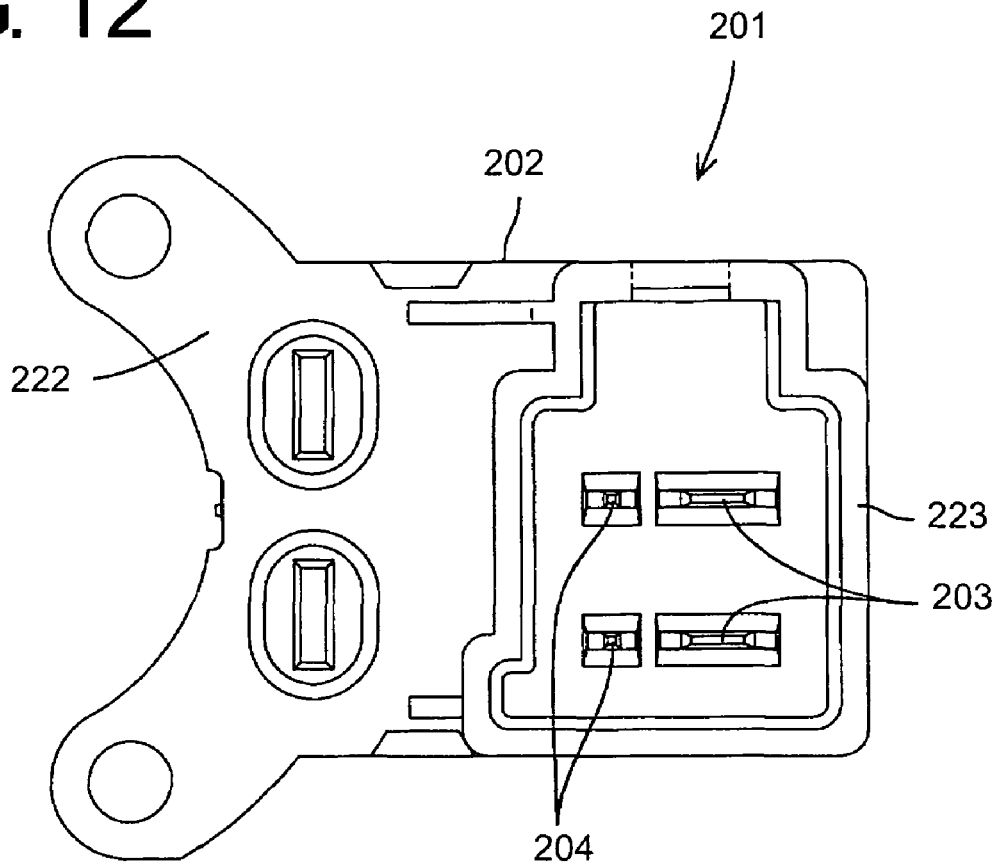
FIG. 12 is a plan view of a connector in which terminals according to the invention are used.
Figure 13:
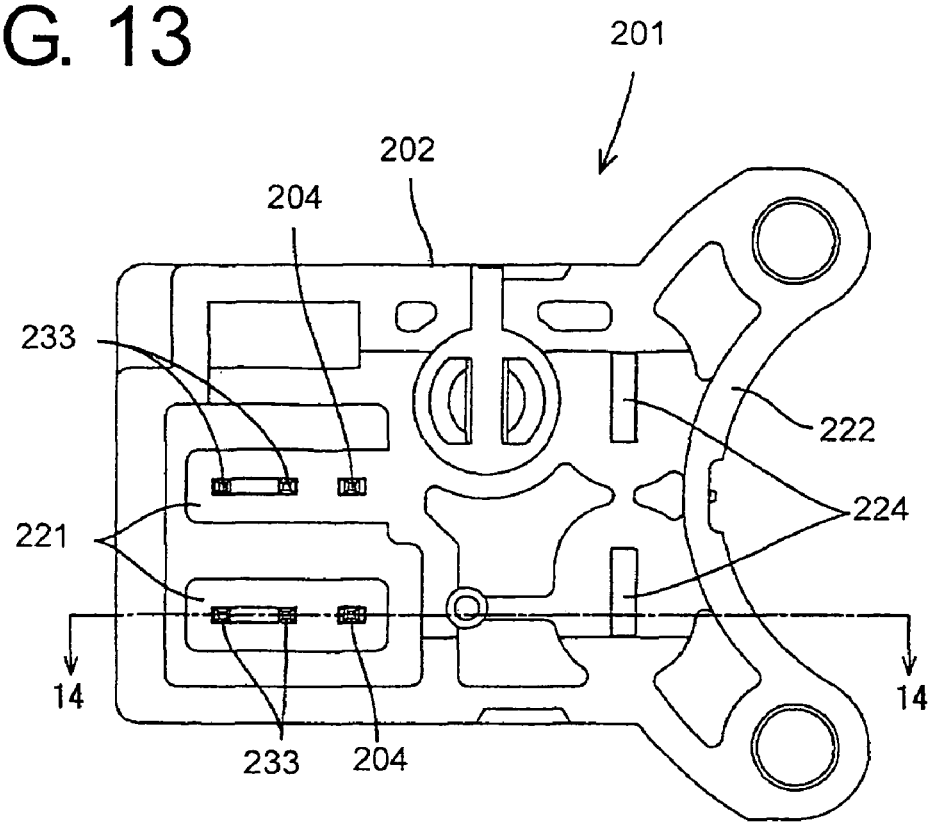
FIG. 13 is a rear view of the connector of FIG. 12.
Figure 14:
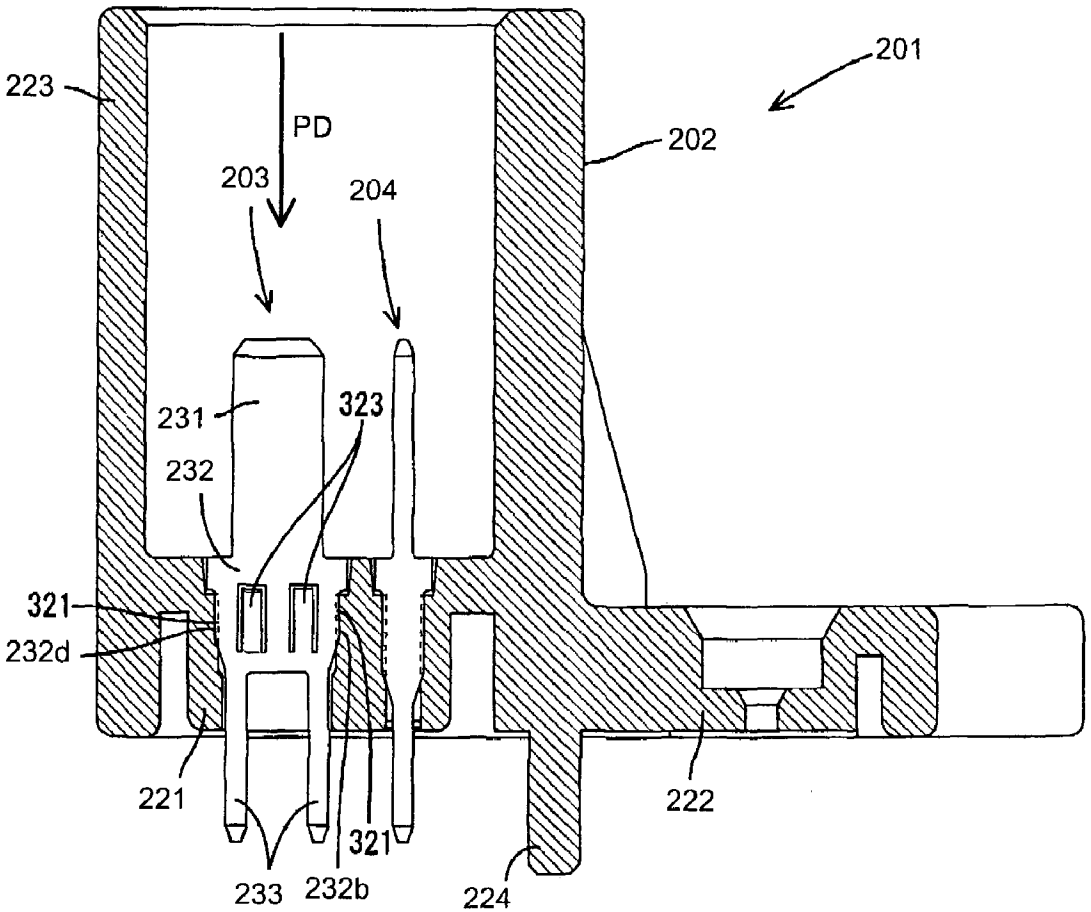
FIG. 14 is a section along 14—14 of FIG. 13 showing the connector according to a first embodiment.

Even though the invention has been described with reference to a terminal having a pair of locks, it should be understood that the invention also covers terminals having three or more locks spaced along the longitudinal direction of the terminal, wherein the mount portion of the housing comprises a corresponding number of engaging portions for engaging the respective locking portions A connector according to a third embodiment of the invention is identified by the numeral 201 in FIGS. 12 to 16. As shown in FIGS. 12 to 14, the connector 201 is a circuit board connector and has two terminals 203 and two narrow terminals 204 accommodated in a housing 202 from above. Each terminal 203 is to be fixed by being pressed into a press-in protrusion 221 of the connector housing 202 from a pressing direction PD, preferably substantially from above.

The housing 202 is molded unitarily e.g. of a synthetic resin and has a flange 222 mountable on an electric or electronic circuit board (not shown). The housing 202 also has a receptacle 223 into which a cable-side connector (not shown) is fittable, and at least one projection 224 for positioning the housing 202 with respect to the electronic circuit board. In FIG. 14, the electronic circuit board is to be mounted on the lower surface of the flange 222 from a direction substantially opposite to the pushing direction PD.

Figure 15:
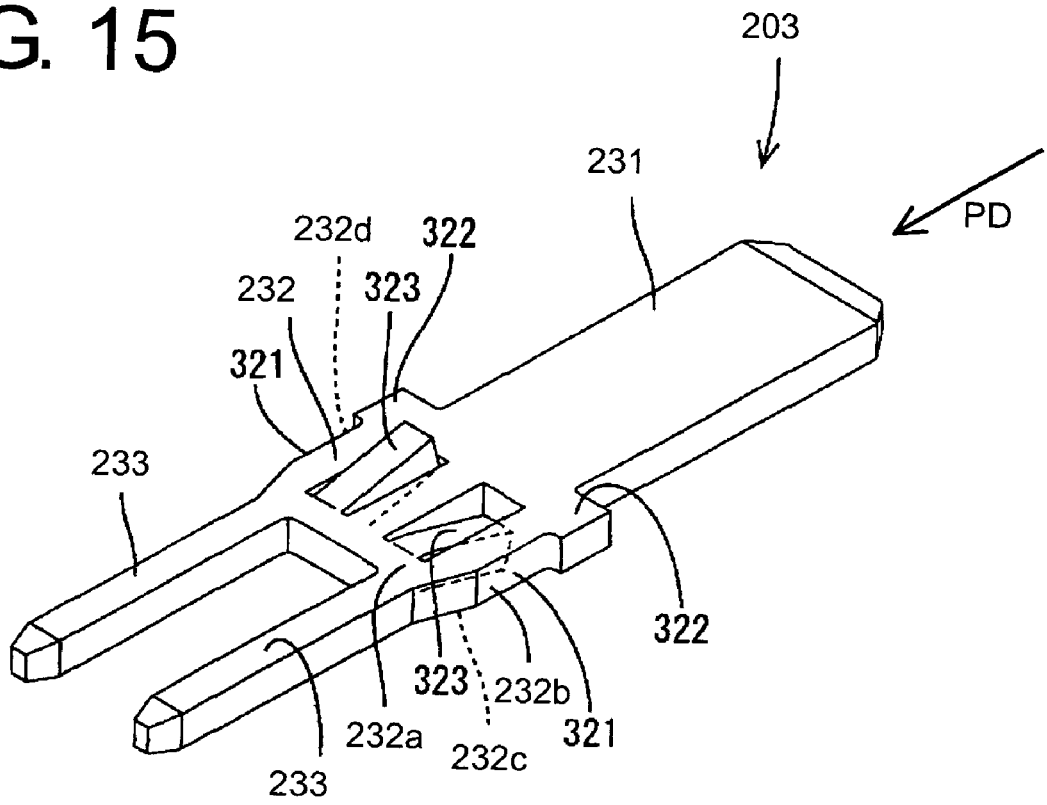
FIG. 15 is a perspective view of a terminal according to a further preferred embodiment.

Each terminal 203 is formed unitarily by press-working a conductive metallic flat plate and, as shown in FIG. 15, has a tab 231 that is fittable into a mating terminal. A base 232 is formed contiguously and continuously below the tab 231, and mounting portions 233 are branched off substantially in the pushing direction PD from the base 232. Leading ends of the mounting portions 233 are electrically connectable with a circuit pattern of the electronic circuit board after mounting the connector on the electronic circuit board.

The base 232 has a substantially squared cross-section with two pairs of opposite outer surfaces 232*a*, 232*c*, 232*b*, 232*d*. Press-in sections 321 are formed respectively on each of the opposite outer surfaces 232*b*, 232*d* and can be pressed into a press-in protrusion 221 of the housing 202. Two receiving sections 322 are formed above the respective press-in sections 321 and can be pressed in the pressing direction PD by an unillustrated terminal-pressing jig. Further, cuts are made in the opposite outer surfaces 232*a*, 232*c* of the base 232, and cut sections are bent in substantially opposite directions so that distal parts of the cut sections bulge out from the outer surfaces 232*a*, 232*c*, thereby forming two resilient engaging pieces 323. The engaging pieces 323 project at an angle to the longitudinal axis of the terminal 203 from the respective outer surface 232*a*, 232*c* so that distal ends are arranged substantially in a rearward direction with respect to the pushing direction PD. One of the two engaging pieces 323 projects from the outer surface 232*a*, whereas the other engaging piece 323 projects from the outer surface 232*c*.

Figure 16:
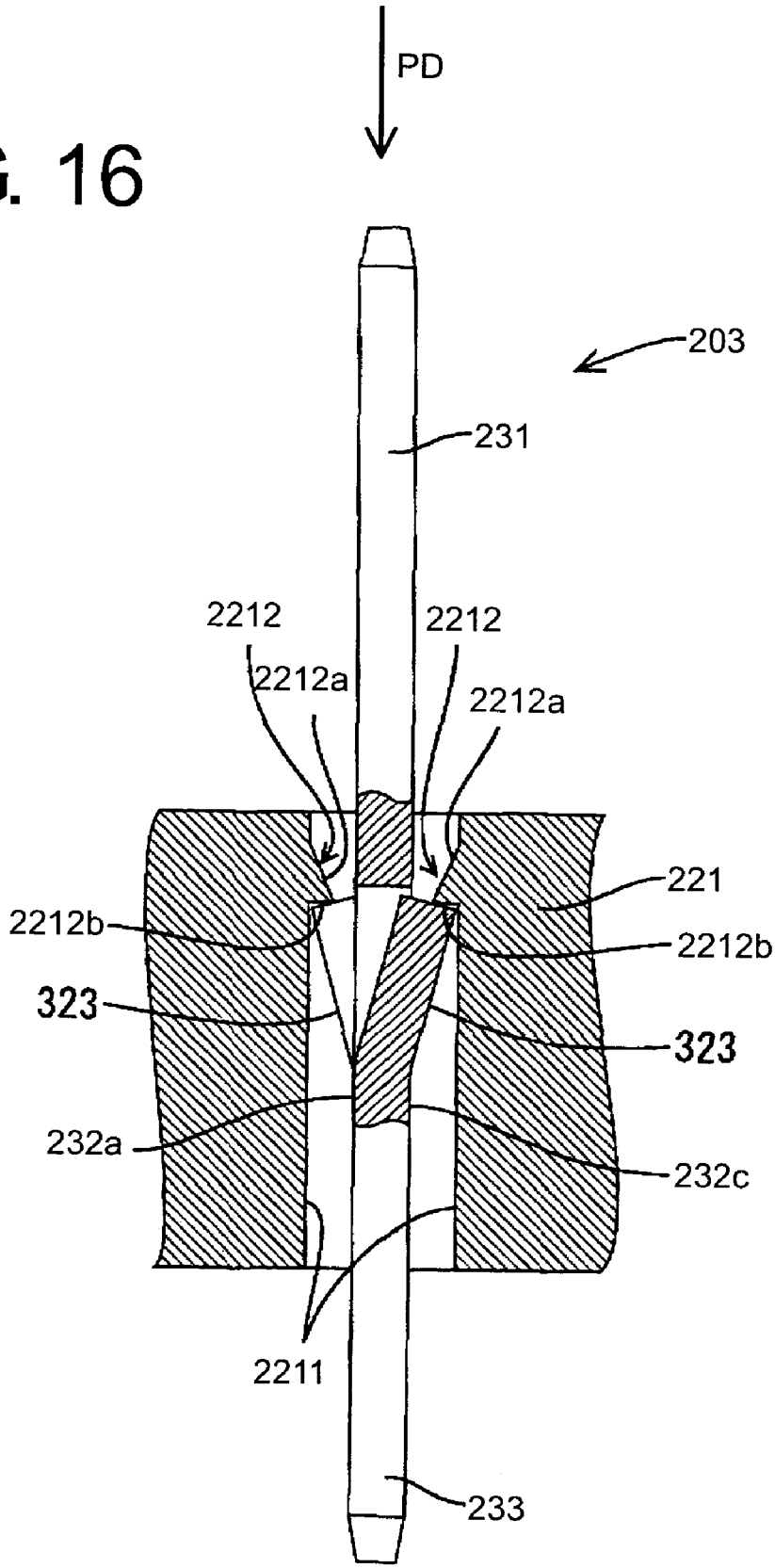
FIG. 16 is a side view in section showing the terminal of FIG. 14.

The press-in protrusion 221 of the housing 202 has substantially opposed surfaces 2211 substantially opposed to the outer surfaces 232*a*, 232*c* of the terminal 203 as shown in FIG. 16. An engaging projection 2212 is formed on each opposed surface 2211 and is engageable with the corresponding locking piece 323. An upper part of each engaging projection 2212 is formed into a slanted surface 2212*a* that is inclined in a direction to be more distanced from the opposed surface 2211 as it extends down in the pushing direction, whereas a lower part thereof defines an end surface 2212*b* aligned substantially normal to the pushing direction PD.

The terminal 203 is pressed into the press-in protrusion 221 in the pressing direction PD, as shown in FIG. 16, so that the two engaging pieces 323 move onto the slanted surfaces 2212*a* of the engaging projections 2212 and deform resiliently inward. The engaging pieces 323 are restored resiliently away from each other after passing the slanted surfaces 2212*a* and engage with the end surfaces 2212*b* of the engaging projections 2212. As a result, the terminal 203 is locked so as not to come out.

The terminal 203 can be held firmly in the housing 202 by the engagement of the engaging pieces 323 and the engaging projections 2212 without substantially increasing a pressing force since the terminal 203 is formed with the flexible engaging pieces 323 and the housing 202 is formed with the engaging projections 2212 engageable with the engaging pieces 323. Further, since the press-in sections 321 are formed on the two facing outer surfaces 232*b*, 232*d* of the terminal 203, and the engaging pieces 323 are formed in the remaining two facing outer surfaces 232*a*, 232*c*, sufficient space can be ensured for the press-in sections 321 and the engaging pieces 323.

The engaging pieces 323 are formed in the metal terminal 203 and thus have increase strength. Therefore, deformation and damage of the engaging pieces 323 caused by the connection and separation of the connector 201 with and from a mating connector can be prevented. Further, one engaging piece 323 is formed on each of the opposite side surfaces of the terminal 203 by making the cuts in the terminal 203 and bending the cut sections in opposite directions. Thus, the terminal 203 can be held stably and firmly without being inclined upon being accommodated into the housing 202.

The engaging pieces alternatively may be formed by embossing the base 232 in such a way that a rear surface of the embossed portion as seen in the pushing direction PD can engage the respective engaging projection 2212 to lock the terminal 203 so as not to come out.

Figure 17:
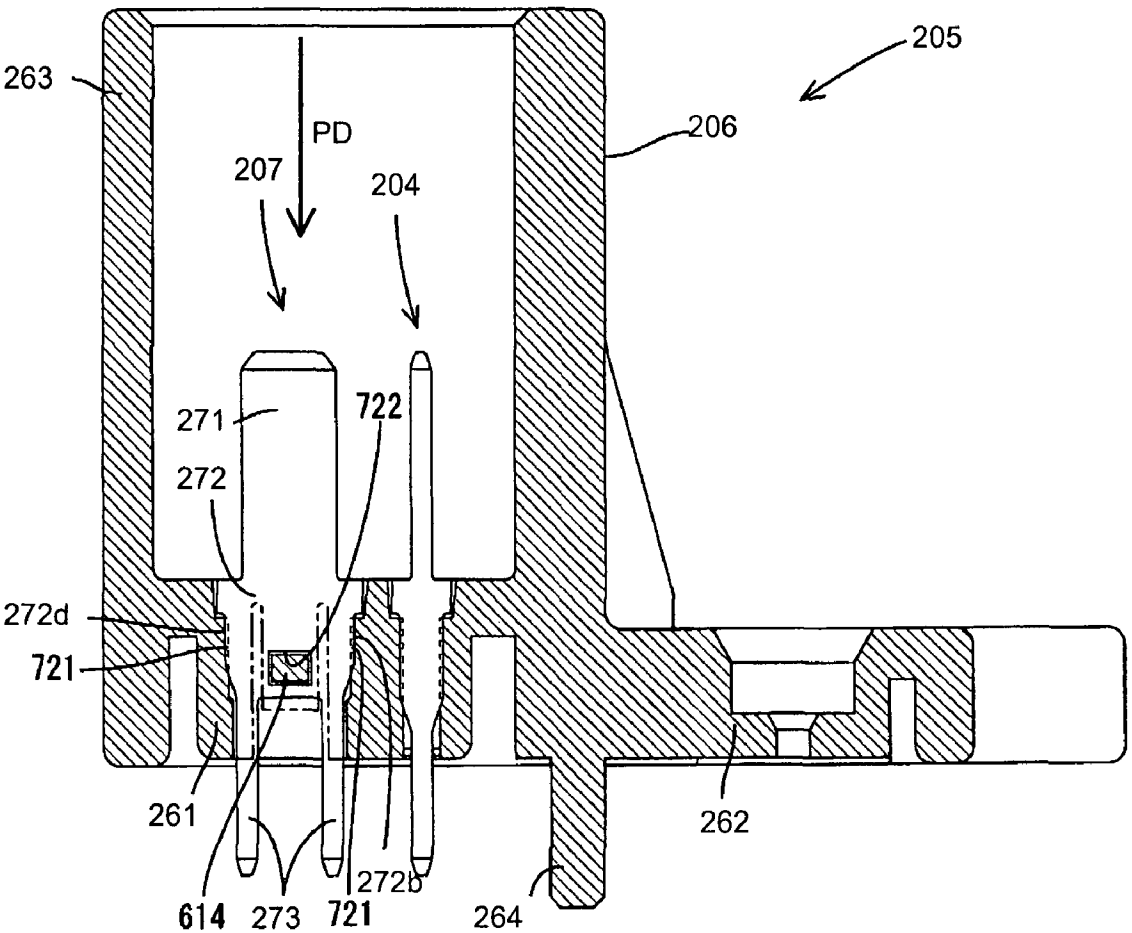
FIG. 17 is a section similar to FIG. 14 but showing a connector according to still a further preferred embodiment.
Figure 18:
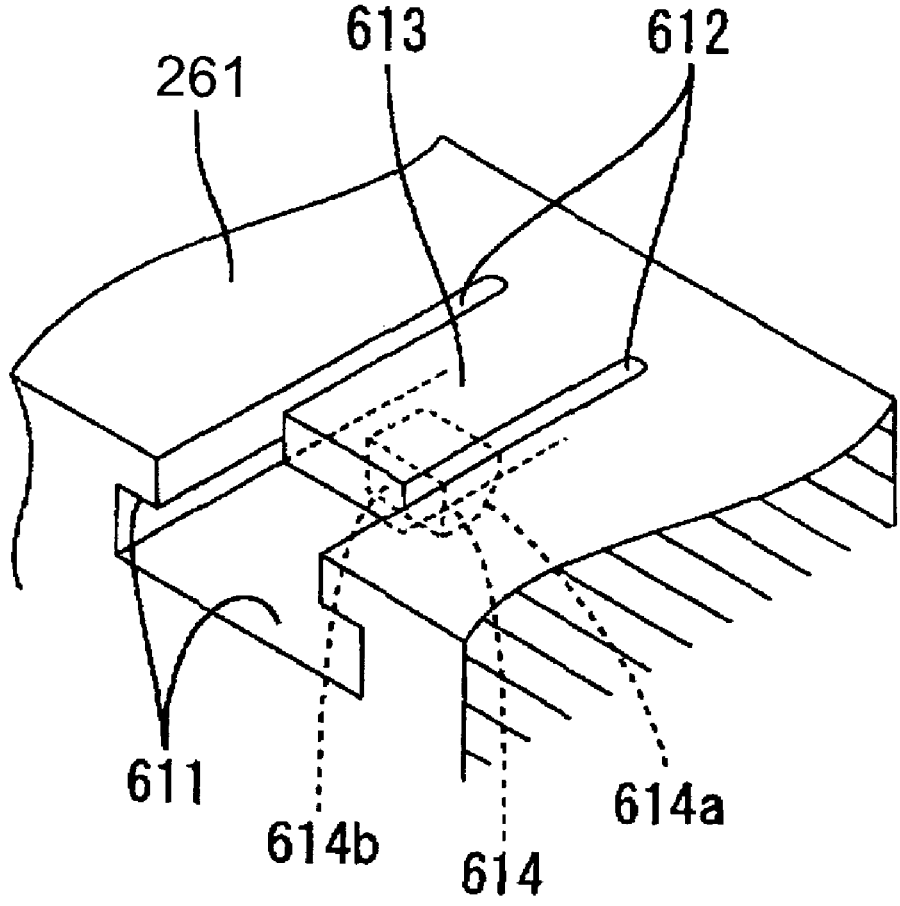
FIG. 18 is a perspective view showing a press-in protrusion of a connector housing according to the embodiment of FIG. 17.
Figure 19:
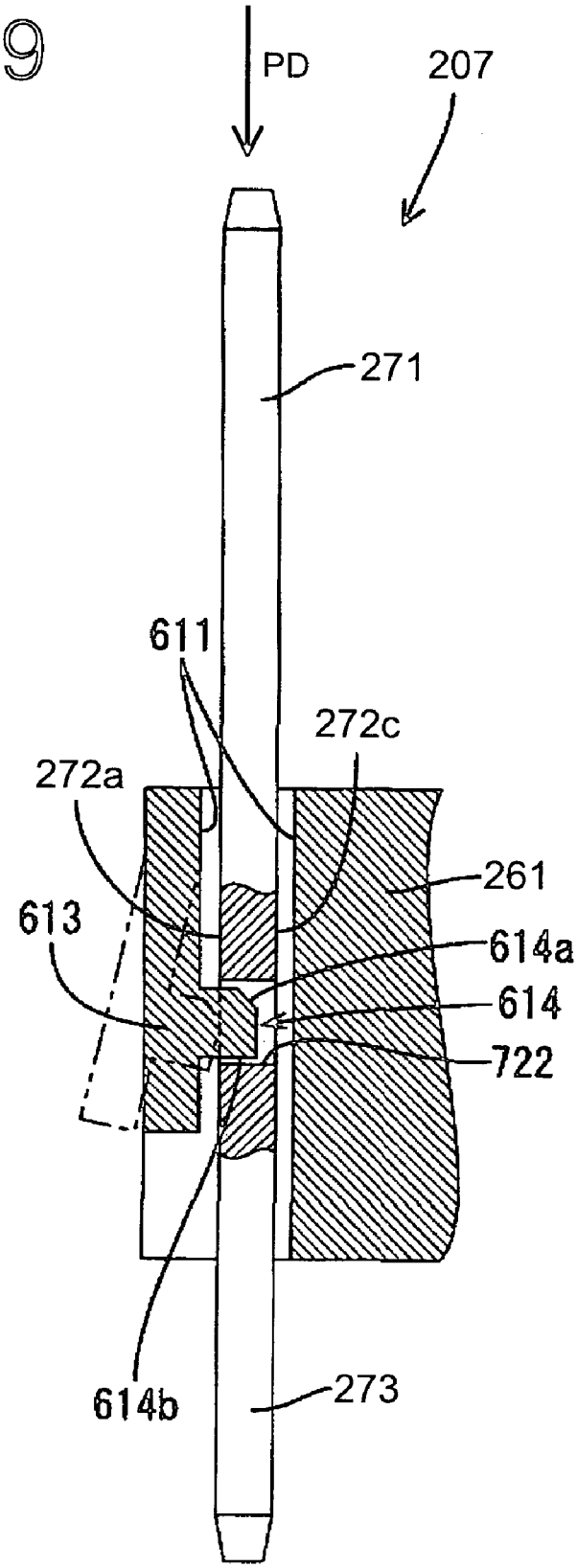
FIG. 19 is a side view in section of a terminal shown in FIG. 17.

A connector according to a further embodiment of the invention is identified by the numeral 205 in FIGS. 17 to 19. The connector 205 according to this embodiment is provided with two terminals 207 and two narrow terminals 204 accommodated in a housing 206. Similar to the previous embodiment, the housing 206 has a flange 262, a receptacle 263, and a projection 264.

Similar to the previous embodiment, the terminal 207 has a tab 271, a base 272 and mounting portions 273. A substantially rectangular engaging hole 722 engageable with an engaging projection 614 formed in a press-in protrusion 261 of the housing 206 is formed substantially in the middle of the base 272 and opens in a pair of substantially facing or opposite outer surfaces 272*a*, 272*c*. It should be noted that press-in sections 272 pressed into the connector housing 206 are formed on the remaining substantially opposite outer surfaces 272*b*, 272*d* of the terminal 207 of this embodiment similar to the previous embodiment.

As shown in FIGS. 18 and 19, the press-in protrusion 261 of the housing 206 is formed with a pair of opposed surfaces 611 opposed to the corresponding outer surfaces 272*a*, 272*c* of the terminal 207. Slits 612 are formed at the opposite sides of one of the opposed surface 611 to form a resilient engaging piece 613, and an engaging projection 614 having a substantially rectangular conforming cross section is formed at a side of the engaging piece 613 toward the terminal 207 substantially in conformity with the shape of the mating engaging hole 722.

As shown in FIG. 19, an upper part of the engaging projection 614 has a slanted surface 614*a* that is inclined to be more distanced from the engaging piece 613 as it extends in the pushing direction PD. Thus, the engaging piece 613 is deformed resiliently when the leading ends of the mounting portions 273 of the terminal 207 move onto the engaging piece 613 upon pressing the terminal 207 into the housing 206 in the pressing direction PD. However, a front part of the engaging projection 614, as seen in the pushing direction PD defines an end surface 614*b* aligned substantially normal to the pushing direction PD. The engaging piece 613 is restored so that the end surface 614*b* of the engaging projection 614 on the engaging piece 613 engages the engaging hole 722. As a result, the terminal 207 is locked so as not to come out.

The invention can be also applied to smaller terminals having no space for an engaging piece by forming the housing 206 with the engaging piece 613.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

It is not always necessary to form one of the housing and the terminal with the engaging piece. Both the housing and the terminal may be formed with the engaging pieces, and may also be formed with engaging portions engageable with the mating engaging pieces.

The housing or the terminal may be formed with three or more engaging pieces.

What is claimed is:

1. A connector terminal, comprising:

at least one press-in portion to be pressed into a housing in a pressing direction and to be accommodated in the housing the press-in portion comprising a base having at least one side surface formed with at least one press-in section to be pressed into the housing, and at least one branch branched off the base and having an outer surface formed with at least one press-in section to be pressed into the housing, the press-in section on the base defining a projecting distance in a direction substantially normal to the pressing direction that is larger than a projecting distance of the press-in section on the branch, wherein the base has opposite side surfaces, each of the opposite side surfaces of the base having at least one of said press-in sections to be pressed into the housing, and the at least one branch comprising a plurality of branches branched off from the base and formed on opposite side surfaces thereof with press-in sections to be pressed into the housing, a width between the press-in sections on the base being larger than a width between the press-in sections on the branches.

2. The connector terminal of claim 1, wherein a tab extends unitarily from the press-in portion for fitting into a mating terminal, the branches branched off from the base extending in a direction substantially opposite from the tab.

3. The connector terminal of claim 1, wherein only one press-in section is formed on each side surface of each branch.

4. The connector terminal of claim 1, wherein the press-in sections formed on the branches are at base ends of the branches.

5. The connector terminal of claim 1, wherein the branches comprise an engaging portion for connection with an external circuit.

* * * * *